US005558154A

United States Patent [19]

Lefeber

[11] Patent Number: 5,558,154

[45] Date of Patent: Sep. 24, 1996

[54] CAPTIVE FLOW DONUT OIL COOLER

[75] Inventor: Thomas E. Lefeber, Racine, Wis.

[73] Assignee: Modine Manufacturing Company, Racine, Wis.

[21] Appl. No.: 983,731

[22] Filed: Dec. 1, 1992

[51] Int. Cl.[6] ..... F28F 3/08

[52] U.S. Cl. ..... 165/51; 165/166; 165/167; 165/916

[58] Field of Search ..... 165/916, 167, 165/51, 166

[56] References Cited

U.S. PATENT DOCUMENTS

| | | | |
|---|---|---|---|
| 4,360,055 | 11/1982 | Frost | 165/167 |
| 4,423,708 | 1/1984 | Sweetland | 165/51 |
| 4,426,965 | 1/1984 | Patel | 165/51 |
| 4,708,199 | 11/1987 | Yogo et al. | 165/167 |
| 4,892,136 | 1/1990 | Ichihara et al. | 165/916 |
| 5,014,775 | 5/1991 | Watanabe | 165/916 |

*Primary Examiner*—John K. Ford

*Attorney, Agent, or Firm*—Wood, Phillips, VanSanten, Clark & Mortimer

[57] ABSTRACT

External conduits for connection to a source of coolant for a donut oil cooler are eliminated in an oil cooler construction including a housing (32) having a base (64). Spaced coolant ports (96,98) are located in the base (64) and a filter mounting surface (68,82) is located on the housing (32) in spaced relation to the base (64). A heat exchange stack (34) is located within the housing (32) and has an oil inlet port (72) in the base (64) and an oil outlet port (76) in the filter mounting surface (68,82). A passage (50) extends through the housing (32) from the base (64) to the surface (68,82).

11 Claims, 1 Drawing Sheet

CAPTIVE FLOW DONUT OIL COOLER

FIELD OF THE INVENTION

This invention relates to heat exchangers, and more particularly, to heat exchangers employed as oil coolers for cooling the oil of internal combustion engines.

BACKGROUND OF THE INVENTION

So-called "donut" oil coolers were invented approximately 20 years ago. This type of oil cooler is a heat exchanger having a round shape with a central opening extending therethrough. Perhaps the earliest example in the patent literature is found in commonly assigned U.S. Pat. No. 3,743,011 issued to Donald J. Frost in 1973. With the progression of time, donut oil coolers have seen increasing popularity because of the relatively high efficiency and small size. Another important feature is their ability to be mounted directly on the engine block of an internal combustion engine at the location ordinarily reserved for the oil filter. The oil filter then, in turn, is mounted on the donut oil cooler, on the side thereof opposite from the block. Two hoses are then connected to the donut oil cooler and to the vehicle coolant system.

Within the donut oil cooler, a stack of individual heat exchange units is located. Engine oil passes through the donut oil cooler to the filter and then is returned through the donut oil cooler to the engine, directly through the engine block. On one of the passes through the donut oil cooler, preferably the pass prior to filtering, the oil is passed through the stack of individual heat exchange units. Engine coolant is flowed about the exterior of the stack to achieve heat rejection from the oil to the engine coolant.

Because of the simplicity, compactness and ease of installation, donut oil coolers have achieved a great deal of popularity and the end of their usefulness is not in sight.

The present invention is directed to an improvement in a donut oil cooler, and more particularly, to the elimination of the need for external coolant lines to be connected between the donut oil cooler and engine cooling system.

SUMMARY OF THE INVENTION

It is the principal object of the invention to provide a new and improved donut oil cooler. More specifically, it is an object of the invention to provide a donut oil cooler of even greater simplicity than those heretofore known.

An exemplary embodiment of the invention achieves the foregoing in an oil cooler adapted to be mounted on the block of an internal combustion engine. The oil cooler includes a housing having a base. Space coolant ports are located in the base. A filter mounting surface is located on the housing and oppositely of the base and a heat exchange stack is disposed within the housing. The stack has an oil inlet or outlet port in the base and an oil outlet or inlet port in the filter mounting surface. A passage extends through the housing from the base to the filter mounting surface.

As a consequence of this construction, oil to be cooled may be admitted to the heat exchange stack through ports in the base as is conventional while coolant may be introduced into the housing from a port in the base and returned to the engine block through another port in the base, thereby eliminating the need for external hose connections into the vehicle cooling system.

In a preferred embodiment, the stack is located between the coolant ports. In a highly preferred embodiment, the base and the housing have parallelogram shapes and the filter mounting surface is an annular surface. The coolant ports are in opposite corners of the parallelogram shape of the base.

A highly preferred embodiment contemplates that the stack be made up of a plurality of interconnected, but spaced, heat exchange units.

In a highly preferred embodiment, there is provided a heat exchanger that includes a stack of heat exchange units. Each unit includes a pair of spaced plates joined at their peripheral edges with the unit in the stack being spaced from one another. Means are provided to define a first passage through the stack such that the first passage is sealed from the heat exchange units. Means are provided to define a second passage in fluid communication with the interiors of the heat exchange units. The second passage has an opening to one end of the stack.

Means are also provided to define a third passage in fluid communication with the interiors of the heat exchange units. The third passage is in spaced relation to the second passage and has an opening to the opposite end of the stack.

A housing contains the stack and the housing includes a base adapted to be abutted to a source of two heat exchange fluids and an opposite side. A pair of first ports are provided. One of the first ports is located in the base and the other is in the opposite side of the housing and the two define opposite ends of the first passage. A second port is located in the base and in fluid communication with the opening for the second passage. A third port is disposed in the opposite side of the housing and is in fluid communication with the third passage opening. Fourth and fifth ports are disposed in the base and spaced from one another on generally opposite sides of the stack.

Consequently, both heat exchange fluids are admitted or egress from ports in the base, eliminating the need for external connections to one or more sources of a heat exchange fluid.

In a preferred embodiment, the base is provided with seal means for sealing against the element to which the heat exchanger may be mounted.

Other objects and advantages will become apparent from the following specification taken into connection with the accompanying drawings.

DESCRIPTION OF THE PREFERRED EMBODIMENT

Figure 1:
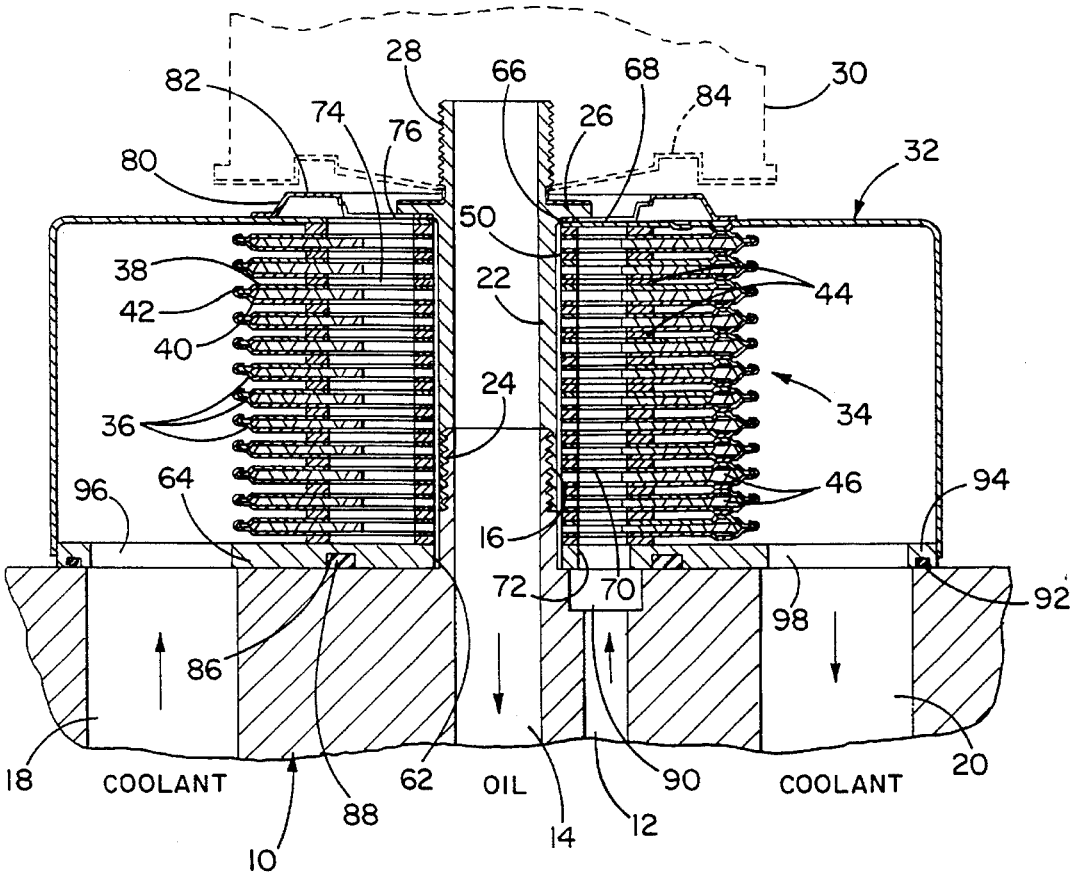
FIG. 1 is a somewhat fragmentary, sectional view of a heat exchanger made according to the invention, shown mounted on the block of an internal combustion engine and mounting an oil filter.

An exemplary embodiment of a heat exchanger made according to the invention is illustrated in FIG. 1 as an oil cooler for the engine oil of an internal combustion engine, as this is apt to be the most likely use for the heat exchanger. However, it is to be understood that the heat exchanger is subject to use in exchanging heat between fluids other than engine oil and engine coolant.

As illustrated in FIG. 1, an internal combustion engine block is schematically illustrated and generally designated 10. The same includes an engine oil outlet 12 which is intended to direct engine oil to a conventional oil filter. An oil return passage 14 is also provided in the block and terminates in a threaded nipple 16 upon which an oil filter would be mounted in a convention fashion.

On one side of the oil passage 12, the block 10 includes a coolant outlet 18 while on the opposite side of the passages 12 and 14, a coolant inlet 20 is provided.

Mounted on the block. 10 by means of an adapter/extender 22 is a heat exchanger made according to the invention. It is to be noted that the adapter/extender 22 may be of the form disclosed in commonly assigned U.S. Pat. No. 4,360,055 issued Nov. 23, 1982 to Donald J. Frost, the details of which are herein incorporated by reference. It is sufficient to say that the adapter/extender 22 includes an internally threaded bore 24 that is threaded on the nipple 16. Oppositely thereof, the adapter/extender 22 includes a hexagonal head 26 and a threaded nipple 28. As schematically illustrated in dotted lines in FIG. 1, a conventional oil filter 30 may be spin mounted on the nipple 28.

The basic components of the heat exchanger are a housing, generally designated 32, and a heat exchange stack, generally designated 34, contained within the housing 32.

As is well known, the stack 34 may be made-up of a plurality of interconnected, but spaced heat exchange units 36. The heat exchange units 36 are in turn made up of a pair of spaced plates 38 and. 40 that are sealed about their peripheries 42 as, for example, by clinching. Spacers 44 of conventional construction may be disposed between individual ones of the units 36 to achieve the desired spacing while the interior of the units 36 may be partially occupied by strand-like turbulators 46 as is well known.

Figure 2:
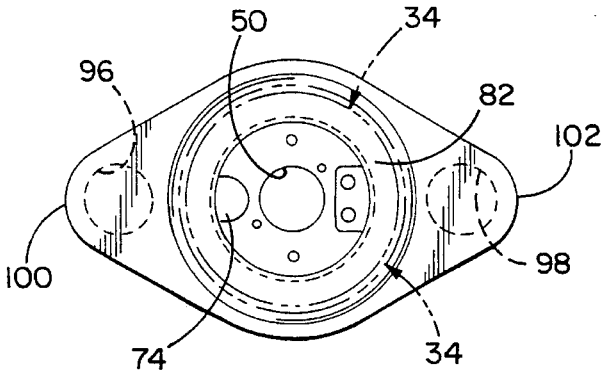
FIG. 2 is a plan view of the heat exchanger.
Figure 3:
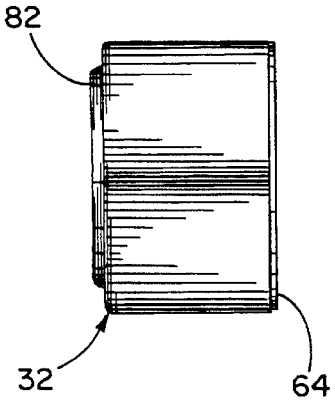
FIG. 3 is a side view of the heat exchanger.

As can be seen in FIG. 2, the stack 34 occupies a generally cylindrical envelope. At its center, each of the units 36 in the stack 34 has a central opening 50 which defines a first passage that extends entirely through the stack 34. Parts of the spacers 44 isolate the passage defined by the opening 50 from the interiors of the individual units 36. The size of the passage defined by the openings 50 is such as to receive the nipple 16 on the block 10 as well as the adapter/extender 22. The passage also terminates at one end in a port 62 in a base 64 of the housing 32. At its opposite end, the port or passage defined by the openings 50 terminates in a port 66 in a filter mounting surface 68 on the side of the housing 32 opposite the base 64.

It will be observed that the hex head 26 on the adapter/extender 22 overlies the surface 68 and when the adapter/extender 22 is threaded in place, the hex head 26 serves to clamp the heat exchanger in place on the engine block 10.

Conventionally, on one side or the center opening, a combination of openings in the spacers 44 and in the plates 38 and 40 define a second passage 70 that is in fluid communication with the interior of the heat exchange units 36. The second passage 70 terminates at one end of the stack in a port 72 in the base 64.

A third passage 74 is defined by openings in the plates 38 and 40 as well as the spacers 44 and is in fluid communication with the interior of the heat exchange units 36 on the side of the central opening 50 opposite from the second passage 70. The passage 74 opens in a port 76 in the surface 68.

The surface 68 of the housing 32 is surrounded by an annular ring-like structure 80 that is typically brazed to the housing 32 and which has an annular, generally planer, sealing surface 82 against which the conventional seal 84 of the filter 30 may sealingly engage.

The base 64 is provided with an annulus seal receiving groove 86 containing a seal 88. The groove 86 is centered on the central opening 50 and disposed to encompass the interface of the base 64 and the oil passages 12 and 14. In this connection, it is to be noted that the oil passage 12 in the block 10 may include a partial or complete annulate 90 that will align with the port 72 when the housing 32 is installed so that engine oil may be introduced into the heat exchanger via the second passage 70.

Returning to the base 64, the same includes, near its periphery, one or more grooves 92 for a corresponding number of O-ring seals 94. The seals 94 are located outwardly of coolant passages 18 and 20 and with the seal 88 serve to confine coolant to a certain part of the interface of the base 64 with the block 10. In this regard, the base 64 includes a port 96 on one side of the stack 34 which aligns with the coolant outlet port 18 to receive and direct coolant to the interior of the housing 32. A coolant outlet port 98 for the heat exchanger is located in the base 64 on the opposite side of the stack 34 and serves to direct coolant from the heat exchanger to the coolant inlet 20.

In a preferred embodiment, the housing 32 and the base 64 thereof are configured as a parallelogram, and even more specifically, as a slightly rounded diamond shape as seen in FIG. 2. The diamond shape has opposite points 100 and 102 in which the ports 96 and 98 are respectively located. Thus, ports 96 and 98 are on opposite sides of the stack 34, assuring uniform flow of coolant between the individual heat exchange units to maximize efficiency.

Oil flow is as conventional in donut oil coolers. As noted previously, oil to be cooled is introduced into the second passage 70. This will place oil within the interior of the individual units 36 and the same will flow about the central opening 50 in each to the third passage 74. The oil will be collected at the third passage 74 and directed via the port 76 to the inlet of the oil filter 30. After being filtered, the oil will be returned to the oil port 14 in the engine block via the adapter/extender 22.

From the foregoing, it will be appreciated that a heat exchanger made according to the invention is ideally suited for use in many applications, particularly as an oil cooler for the engine oil of an internal combustion engine. By virtue of the unique disposition of the fluid ports in a single, generally planer base such as the base 64, it is possible to avoid the external coolant connections heretofore required by oil coolers of this type. Needless to say, this advantageously avoids points of possible leakage as well as the use of hoses that will require periodic replacement. Installation becomes simpler.

Furthermore, a greater quantity of coolant can be introduced into the heat exchanger over a given period of time than would be the case if conventional external conduits were employed. The greater quantity of coolant, of course, increases heat rejection.

In addition, it will be observed from FIG. 1, that oil flow through the individual heat exchange units 36 is generally from right to left whereas coolant flow within the heat exchanger is generally from left to right. Thus, a truly countercurrent flow of the two fluids for maximum efficiency is obtained. In conventional donut oil coolers, only partial countercurrent flow can be obtained.

It will thus be appreciated that the heat exchanger made according to the invention provides several advantages over those heretofore known.

I claim:

1. In a heat exchanger, the combination of:

a stack of heat exchange units, each unit including a pair of spaced plates joined at their peripheral edges, the units in said stack further being spaced from one another;

means defining a first passage through said stack, said first passage being sealed from said heat exchange units;

means defining a second passage in fluid communication with the interior of said heat exchange units and having an opening to one end of said stack;

means defining a third passage in fluid communication with the interior of said heat exchange units in spaced relation to said second passage having an opening to the other end of said stack;

a housing containing said stack, said housing including a base adapted to be abutted to a source of two heat exchange fluids, and an opposite side;

a pair of first ports, one in said base and the other in said opposite side and defining opposite ends of said first passage;

a second port in said base and in fluid communication with said second passage opening;

a third port in said opposite side and in fluid communication with said third passage; and fourth and fifth ports in said base and spaced from one another on generally opposite sides of said stack.

2. The heat exchanger of claim 1 wherein said base is provided with seal means for sealing against an element to which said heat exchanger may be mounted.

3. The heat exchanger of claim 1 wherein said opposite side includes an annular sealing surface surrounding said other first port and said third port and adapted to be sealingly engaged by a seal.

4. The heat exchanger of claim 3 wherein said base is provided with seal means for sealing against an element to which said heat exchanger may be mounted.

5. The heat exchanger of claim 1 wherein said stack is generally cylindrical and said base is diamond shaped to have two oppositely directed points, said stack being centered on said base and said fourth and fifth ports are located in a respective one of said points.

6. An oil cooler adapted to be mounted on the block of an internal combustion engine, comprising:

a housing defining a coolant space and having a base;

spaced coolant ports in said base and in fluid communication with said space;

a filter mounting surface on said housing spaced from said base;

a heat exchange stack within said housing and the coolant space therein, said stack having an oil inlet or outlet port in said base and an oil outlet or inlet port in said surface; and a passage extending through said housing from said base to said surface.

7. The oil cooler of claim 6 wherein said stack is located between said coolant ports.

8. The oil cooler of claim 6 wherein said stack is made up of a plurality of interconnected, but spaced, heat exchange units.

9. The oil cooler of claim 6 wherein said base is generally planar.

10. The oil cooler of claim 6 wherein said base and said housing have parallelogram shapes and said surface is an annular surface.

11. The oil cooler of claim 10 wherein said coolant ports are in opposite corners of said parallelogram shape of said base.

* * * * *